US005651195A

United States Patent [19]

Clancy

[11] Patent Number: 5,651,195

[45] Date of Patent: Jul. 29, 1997

[54] SPORTS SANDAL

[75] Inventor: James F. Clancy, Santa Monica, Calif.

[73] Assignee: L.A. Gear, Inc., Santa Monica, Calif.

[21] Appl. No.: 611,805

[22] Filed: Mar. 6, 1996

[51] Int. Cl.[6] ..... A43B 3/12

[52] U.S. Cl. ..... 36/11.5; 36/50.1

[58] Field of Search ..... 36/11.5, 50.1, 36/114

[56] References Cited

U.S. PATENT DOCUMENTS

| | | | |
|---|---|---|---|
| 2,169,337 | 8/1939 | Davis | 36/11.5 |
| 2,551,723 | 5/1951 | Camero | 36/11.5 |
| 2,724,913 | 11/1955 | Russell | 36/11.5 |
| 3,841,003 | 10/1974 | Huyge | 36/11.5 |
| 4,107,857 | 8/1978 | Devlin | 36/11.5 |
| 4,294,023 | 10/1981 | Banford | 36/11.5 |
| 5,467,537 | 11/1995 | Aveni et al. | 36/50.1 |

*Primary Examiner*—M. D. Patterson
*Attorney, Agent, or Firm*—Don C. Lawrence

[57] ABSTRACT

A sports sandal includes sole and a partial upper. The partial upper includes a plurality apertures that accommodate a lace therethrough. The lace tension is selectively adjustable and the partial upper is flexible and contoured to fit snugly about the wearer's foot. The use of flexible fabrics enable the sports sandal to be used in a wider variety of athletic activities, while the adjustable lacing system adds to wearer's comfort.

5 Claims, 2 Drawing Sheets

SPORTS SANDAL

RELATED APPLICATIONS

This application is related to U.S. Design patent application Ser. No. 29/051,310, filed concurrently herewith, entitled SPORTS SANDAL, which application is, by this reference, incorporated herein in its entirety.

BACKGROUND OF THE INVENTION

1. Field of the Invention

The present invention relates to a sports sandal. More particularly, it is directed to an all-purpose sports sandal that incorporates a novel lacing system.

2. Description of the Related Art

Sandal style footwear has been worn by people for literally thousands of years. Lacing systems for sandals, when provided, typically include a lace threaded through one or more eyelets disposed on an upper portion of the sandal. Grommets may be provided to reinforce the eyelet and prevent damage to the sandal. The lace is typically threaded in a cross pattern through the eyelets and tied at both ends near the ankle of the wearer. The lacing system pulls together two sides of the sandal to secure the sandal to the wearer's foot.

Sandals traditionally have not been associated with athletic or active endeavors. Rather, they are generally looked upon as casual footwear suitable for light walking, for example, around the home or at the beach. Thus, when an individual plans to participate in sports activities, or engage in extensive walking or hiking, sandals are not generally considered suitable footwear.

One resulting problem is that when traveling, an individual often must pack a variety of footwear to accommodate his or her planned activities. For example, while sandals might be considered suitable for lounging use, e.g., at the beach, around the pool, at a resort or on a cruise ship, athletic shoes are generally thought by most people as more suitable for such activities as sightseeing, hiking, and sporting events, such as volleyball, tennis, etc.

One of the reasons for this thinking is that, while sandals generally fall into two categories, viz., the "open-heel" variety and the "closed-heel" or secured-heel variety, neither type typically provides the support and flexibility associated with athletic shoes. Closed-heel sandals typically do not have lacing systems that provide the security, comfort, and flexibility necessary to engage in lengthy and energetic activities such as athletics, extended walking, hiking, etc.

Open-heeled sandals are typically provided with a single strap that passes over the wearer's foot above the bridge, or a combination of a strap with a toe-thong that extends from a strap over the bridge of a wearer's foot to the sole of the sandal, and which is generally positioned between two of the wearer's toes. Such open-heeled sandals likewise do not provide the security, support and flexibility sought by people who engage in athletic activities.

Closed-heeled sandals typically include a strap or upper portion positioned behind the wearer's heel to support the wearer's foot within the sandal. Such sandals are often designed to provide a certain fashionable appearance, but do not have the support and flexibility necessary to engage in athletic or strenuous activities for extended periods of time. Further, the straps are generally not flexible enough for athletic activities and can often chafe or rub the wearer such that the wearer develops blisters or abrasions on the heels.

Both open- and closed-heel sandals typically provide no support for the ankle of the wearer, since they lack an upper.

Athletic footwear typically requires greater support around the ankle and over the top portion of the foot, and certain sports demand greater shoe flexibility than typical sandals can provide.

Accordingly, there is a need for a sandal that is comfortable and flexible, yet which supports the wearer's foot in a variety of activities, and which is provided with a sandal lacing system that is capable of providing greater comfort, flexibility and closure speed than prior art lacing systems, and which desirably can accommodate more than one lace.

SUMMARY OF THE INVENTION

The present invention is directed to a sports sandal that overcomes the difficulties associated with prior art sandals, and which includes a support and lacing system that satisfies the need for greater comfort, flexibility, and closure speed than previous lacing systems. The sports sandal of the present invention is suitable for extended wear, and provides the flexibility, comfort and more enhanced support required for walking, hiking, and other athletic activities.

In accordance with the present invention, a sports sandal is provided that includes a lacing system with a ball having an aperture therethrough disposed along a rear portion of the heel. A first plurality of apertures are disposed along a heel of the sandal. A second plurality of apertures are disposed along sides of the heel of the sandal. A third plurality of apertures are disposed along sides of a partial upper of the sandal. A hood member is disposed longitudinally along the partial upper of the sandal and adjacent the third plurality of apertures. Two laces are then each threaded through the ball aperture, one of the first plurality of apertures, one of the second plurality of apertures, at least two of the third plurality of apertures, and the hood member. Finally, an end of each lace is secured to a quarter of the sandal.

By providing the sandal with the partial upper formed of supportive, flexible material, and providing the lacing system as described above, a sandal is provided that affords the wearer greater support and flexibility, yet with a closure that is quick and easy to effect. A more complete understanding of the present invention will be afforded to those skilled in the art, as well as a realization of additional advantages and objects thereof, by a consideration of the following detailed description of the preferred embodiment in conjunction with the drawings, a brief description of which now follows.

DETAILED DESCRIPTION OF THE PREFERRED EMBODIMENT

Figure 1:
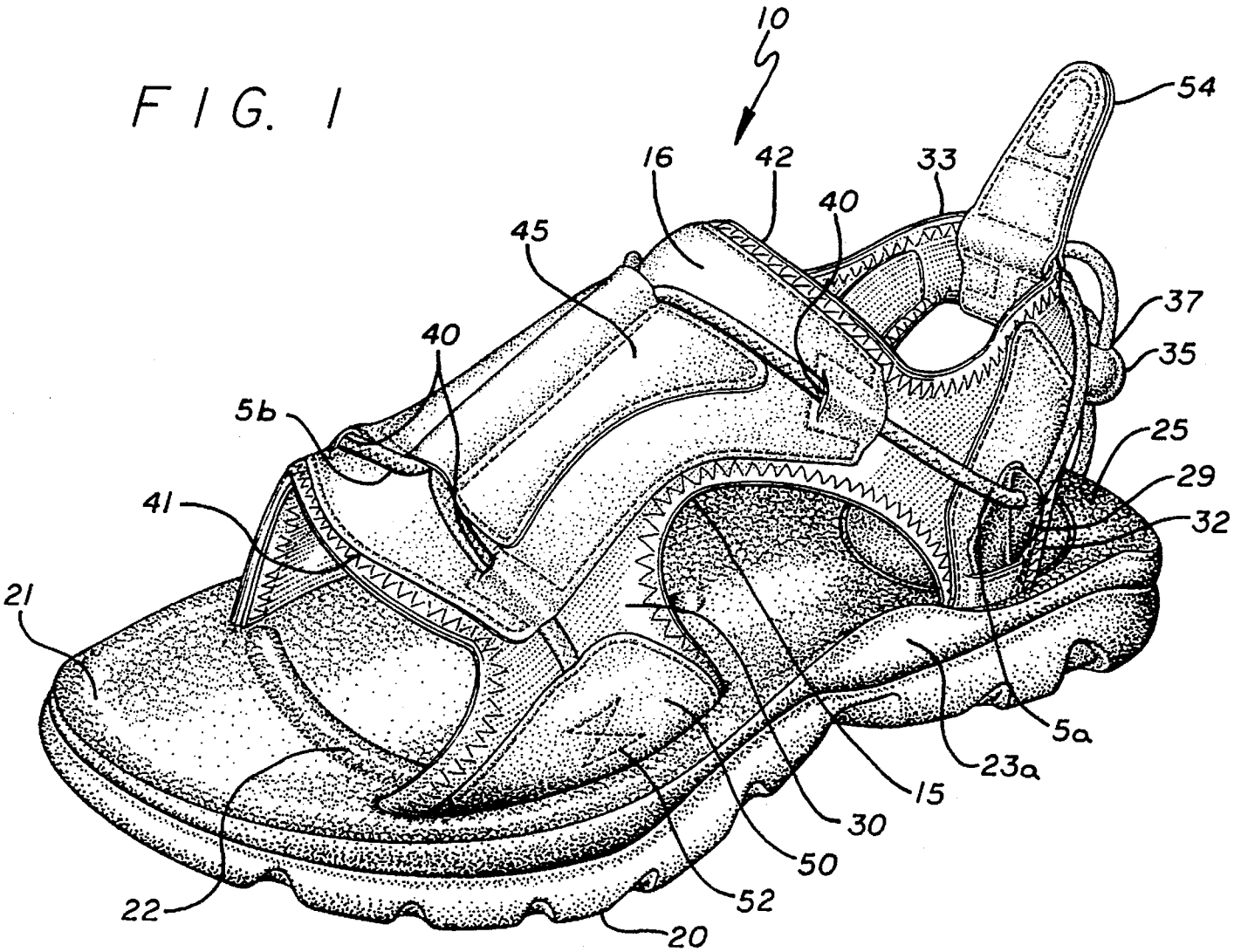
FIG. 1 is a front perspective view of a sandal including the lacing system of the present invention.

As shown in FIG. 1, a sandal 10 has a sole 20, a partial upper 15 positioned above the sole 20. A portion of the partial upper extends between the toe and the side of the wearer's foot and is termed the forward quarter 30. A second portion of the partial upper extends from below the wearer's ankle downward to the sole 20, and is termed the rear quarter 32. The partial upper 15 is attached to the sole 20 of the sandal by glue, adhesive, stitching, or other suitable means. The partial upper 15, which is preferably shaped to cover the instep of the wearer and to include the from and rear quarter portions 30, 32, can be made from leather, suede, nylon, or canvas, although preferably, a combination of suede and stretchable nylon is utilized. Of course, any combination of suitable materials may be utilized.

The front and rear quarter portions 30, 32 serve to attach the partial upper 15 to the sole 20 adjacent the lateral sides of the wearer's foot near the toes and below the ankle by means of a strap 33 surrounding the heel. The sole 20 is generally composed of rubber, polyurethane, foamed ethylene vinyl acetate (EVA), butadiene, styrene butadiene, or isoprene. The upper surface 21 of the sole 20 is preferably contoured to accommodate the underside of wearer's foot, and in particular, to provide support, i.e., a "foot bed," therefor.

Figure 2:
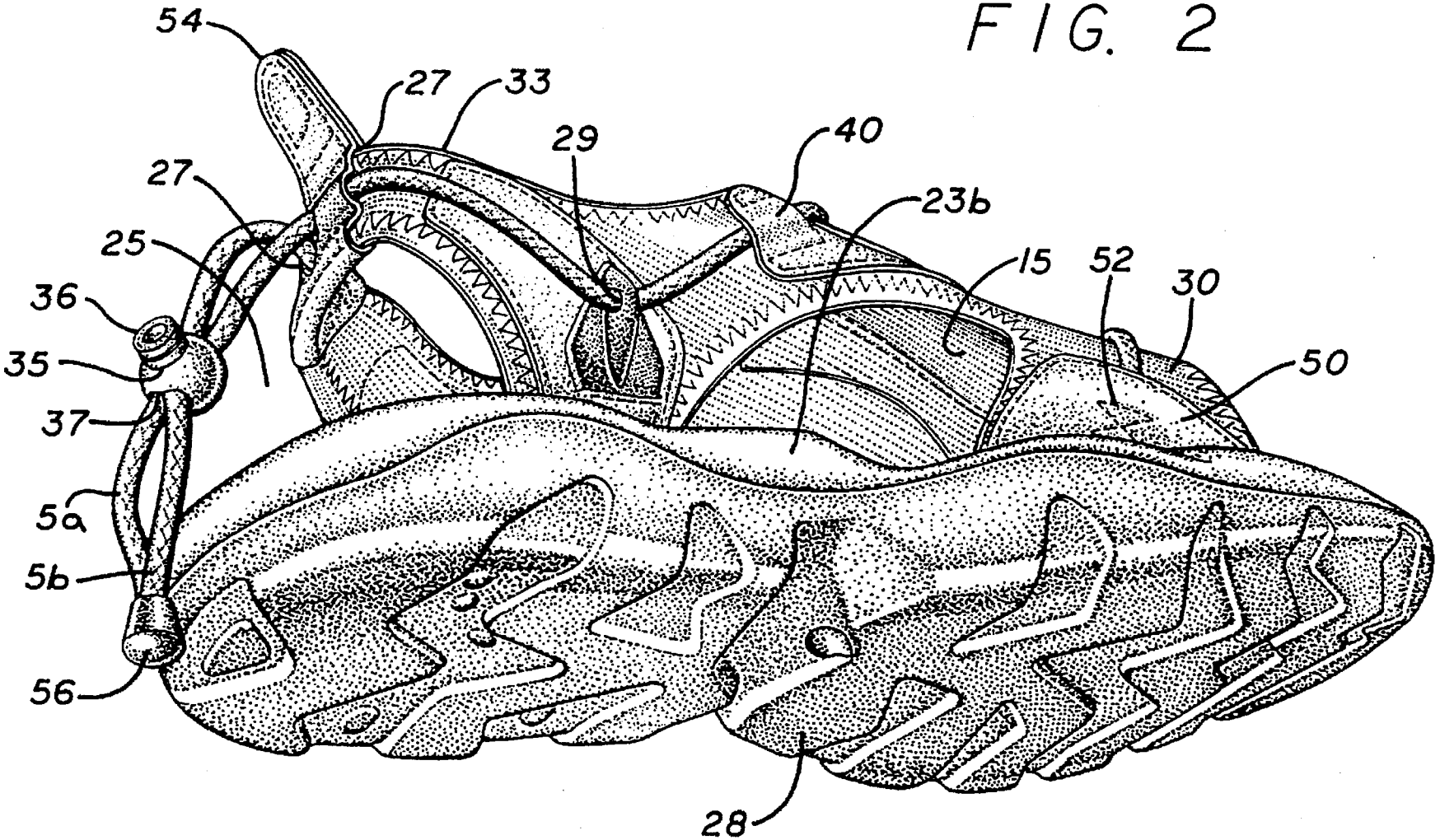
FIG. 2 is a bottom perspective view thereof.

The sole 20 includes a laterally and arcuately formed support ridge 22 that provides support for the toes, prevents the ball of the foot from sliding forward in the sandal, and allows the toes to grip the sandal to provide appropriate traction. Lateral side support ridges 23*a* and 23*b* are also provided on both sides of the sole 20 to support the sides of the wearer's foot. The lateral support ridge 23*a* provides support for the exterior lateral side surface of the wearer's foot, as seen in FIG. 1, and the lateral support ridge 23*b* provides support for the interior lateral side surface, or arch, of the wearer's foot, as may be seen in FIG. 2.

The lacing system of the sandal is coupled to the partial upper 15, and includes a ball-shaped, spring-biased clamp 35 that is affixed to laces 5*a* and 5*b* at the of the sandal 10. The clamp 35, which is preferably of a known type of spring-biased pressure clamp, such as that manufactured by TIFCO and described in U.S. Pat. No. 4,288,891, provides for adjustable placement on the laces 5*a* and 5*b* through actuation of an operating member 36.

In addition to the laces 5*a*, 5*b*, the partial upper 15 includes a first plurality of apertures 27 disposed on the strap portion 33 rearward of the heel of the wearer. A second plurality of apertures 29, preferably formed within rigid plastic, wood or leather grommets or eyelets 31 to provide additional lateral support, are disposed along either side of the heel 25 on the rear quarters 32 at positions below the wearer's ankles. The rigid grommets or eyelets 31 are preferably formed from plastic through injection molding, or other suitable means. The grommets or eyelets 31 are securely fastened to the rear quarters 32 through stitching, adhesives, or a combination thereof, and the apertures 29 are sized within them such that the laces 5*a*, 5*b* are relatively free-running through them.

A third plurality of apertures 40 are disposed at essentially the "corners" of the instep on the partial upper of the sandal 10. As shown in FIG. 1, the third plurality of apertures 40 include four apertures, two of which are disposed towards the front portion 41 of the partial upper 15, and two of which are disposed towards the rear portion 42 of the partial upper 15. In addition to the apexlures, a center tunnel portion 45 is disposed on the instep portion and channels the laces 5*a* and 5*b* along the upper surface of the instep portion 16 of the partial upper 15. The center tunnel serves to "bridge," or span, the paths of tension in the lace that occurs between the forefoot and the instep during a single cinching action, as described below.

The laces 5*a*, 5*b*, which may comprise a single lace, are threaded through an aperture 37 formed in the clamp 35 and through one of the first set of apertures 27 on the strap portion 33. The laces 5*a*, 5*b* are then threaded through the apertures 29 formed on the side of the heel and through two of the third set of apertures 40 that are positioned on the rear portion 42 of the instep portion 16 of the partial upper 15. The laces 5*a* and 5*b* are then threaded through the tunnel portion 45 towards forward portion 41 of the partial upper 15. The laces 5*a* and 5*b* are then secured to the respective forward quarters 30 of the sandal. The laces are affixed to securing tabs 50, which form a part of the forward quarters 30, preferably by stitching 52, riveting, or by other suitable means.

In operation, the wearer dons the sandal by inserting a foot into it and pulling on the strap secure tab 54 to slip the strap portion 33 of the sandal loosely up over the calcaneus of the heel. The laces are then tightened by a single, rearward pull on the knob portion 56 connected to the laces 5*a*, 5*b*, and the clamp member 35 is moved to a position immediately abutting the first apertures 27 by depressing the operating member 36 and sliding the clamp 35 to the desired position. Once the clamp 35 is positioned as desired, the operating member 36 is released and the biasing force of the spring biased clamp 35 secures the clamp in place on the lace. Thus, with a single pull on the knob 56, the present invention provides for the overall adjustment of the sandal on the wearer's forefoot, instep and Achilles tendon, and provides a fitting of the sandal to the wearer's foot that is both comfortable, yet secure during more strenuous activities.

Having thus described a preferred embodiment of a sports sandal incorporating a novel lacing system, it should be apparent to those skilled in the art that certain advantages of the within system have been achieved. It should also be appreciated that numerous modifications, changes, and/or additions may be made to the invention described herein without departing from the spirit and scope of the present invention. It is intended that all such modifications, changes, and/or additions fall within the scope of the present invention, which is best defined by the claims that appear below.

What is claimed is:

1. A sports sandal comprising:

a sole having a forward portion for accommodating a wearer's toes and a rearward portion for accommodating a wearer's heel;

a partial upper attached to said sole at a plurality of points, said upper being formed of resilient and flexible material and including an instep portion and a heel strap;

a first pair of attachment straps for securing said partial upper to said sole;

a first plurality of apertures disposed on said heel strap;

a second plurality of apertures disposed on said partial upper adjacent said first pair of attachment straps;

a third plurality of apertures disposed on said instep portion at a position substantially adjacent said rearward portion of said sole;

a fourth plurality of apertures disposed on said instep portion at a position substantially adjacent said forward portion of said sole; and, at least one lace threaded through each of said first, second, third and fourth plurality of apertures and secured to said sandal, said at least one lace surrounding a portion of said sandal and being selectively adjustable about a wearer's foot.

2. The sports sandal according to claim 1, further comprising means for coupling the at least one lace to said instep portion.

3. The sports sandal according to claim 2, wherein the lace coupling means comprise a plurality of stitches that sew said at least one lace to said instep portion.

4. The sports sandal according to claim 1, further comprising lace tensioning means for selectively adjusting tension on said at least one lace.

5. The sports sandal according to claim 4, wherein said lace tensioning means includes an adjustable clamp having an aperture therethrough for said at least one lace.

* * * * *